US008568214B1

(12) United States Patent
Shoemaker, Jr.

(10) Patent No.: US 8,568,214 B1
(45) Date of Patent: Oct. 29, 2013

(54) ARCADE GAME WITH ROTATING AND COUNTER ROTATING POINTER AND TURNTABLE

(71) Applicant: Stephen P. Shoemaker, Jr., Redondo Beach, CA (US)

(72) Inventor: Stephen P. Shoemaker, Jr., Redondo Beach, CA (US)

( * ) Notice: Subject to any disclaimer, the term of this patent is extended or adjusted under 35 U.S.C. 154(b) by 0 days.

(21) Appl. No.: 13/648,612

(22) Filed: Oct. 10, 2012

(51) Int. Cl.
*A63F 9/24* (2006.01)

(52) U.S. Cl.
USPC ..... 463/7; 463/16; 463/17; 463/18; 463/19; 463/20

(58) Field of Classification Search
USPC ..... 463/7
See application file for complete search history.

(56) References Cited

U.S. PATENT DOCUMENTS

| | | | | |
|---|---|---|---|---|
| 3,975,022 | A * | 8/1976 | Figueroa | 273/141 A |
| 4,272,082 | A | 6/1981 | Shoemaker, Jr. et al. | |
| 4,303,248 | A | 12/1981 | Shoemaker, Jr. et al. | |
| 4,726,585 | A | 2/1988 | Shoemaker et al. | |
| 4,822,045 | A | 4/1989 | Shoemaker et al. | |
| 4,941,665 | A * | 7/1990 | Klamer | 273/142 H |
| 5,184,821 | A * | 2/1993 | Korenek | 273/138.2 |
| 5,553,865 | A | 9/1996 | Shoemaker et al. | |
| 5,584,763 | A * | 12/1996 | Kelly et al. | 463/16 |
| 5,855,374 | A | 1/1999 | Shoemaker et al. | |
| 6,095,519 | A | 8/2000 | Shoemaker et al. | |
| 6,139,429 | A | 10/2000 | Shoemaker, Jr. | |
| 6,598,881 | B1 | 7/2003 | Shoemaker, Jr. | |
| 6,770,001 | B1 | 8/2004 | Shoemaker, Jr. | |
| 6,991,230 | B1 | 1/2006 | Shoemaker | |
| 7,168,702 | B1 | 1/2007 | Shoemaker | |
| 2004/0014517 | A1 * | 1/2004 | Inoue | 463/20 |
| 2005/0113159 | A1 * | 5/2005 | Kelly et al. | 463/7 |
| 2005/0227755 | A1 * | 10/2005 | Nordman | 463/20 |
| 2006/0135249 | A1 * | 6/2006 | Seelig et al. | 463/22 |
| 2009/0104991 | A1 * | 4/2009 | Seelig et al. | 463/33 |
| 2009/0247267 | A1 * | 10/2009 | Acres | 463/20 |
| 2011/0177859 | A1 * | 7/2011 | Winegardner | 463/20 |
| 2011/0281634 | A1 * | 11/2011 | Mattice et al. | 463/20 |
| 2012/0122571 | A1 * | 5/2012 | DeSimone et al. | 463/31 |

* cited by examiner

*Primary Examiner* — Ronald Laneau
*Assistant Examiner* — Justin Myhr
(74) *Attorney, Agent, or Firm* — Fulwider Patton LLP

(57) ABSTRACT

An arcade type amusement game is disclosed having a housing with a playing field therein, the game further comprising a turntable and a counter rotating pointer. A pair of motors control the rotation and counter rotation of the turntable and pointer, initiated and stopped by player controls. The coincidence of the pointer over the turntable's sectors determine a reward for the player, modified by a quadrant of the playing field to which the pointer comes to rest.

6 Claims, 3 Drawing Sheets

FIG. 3
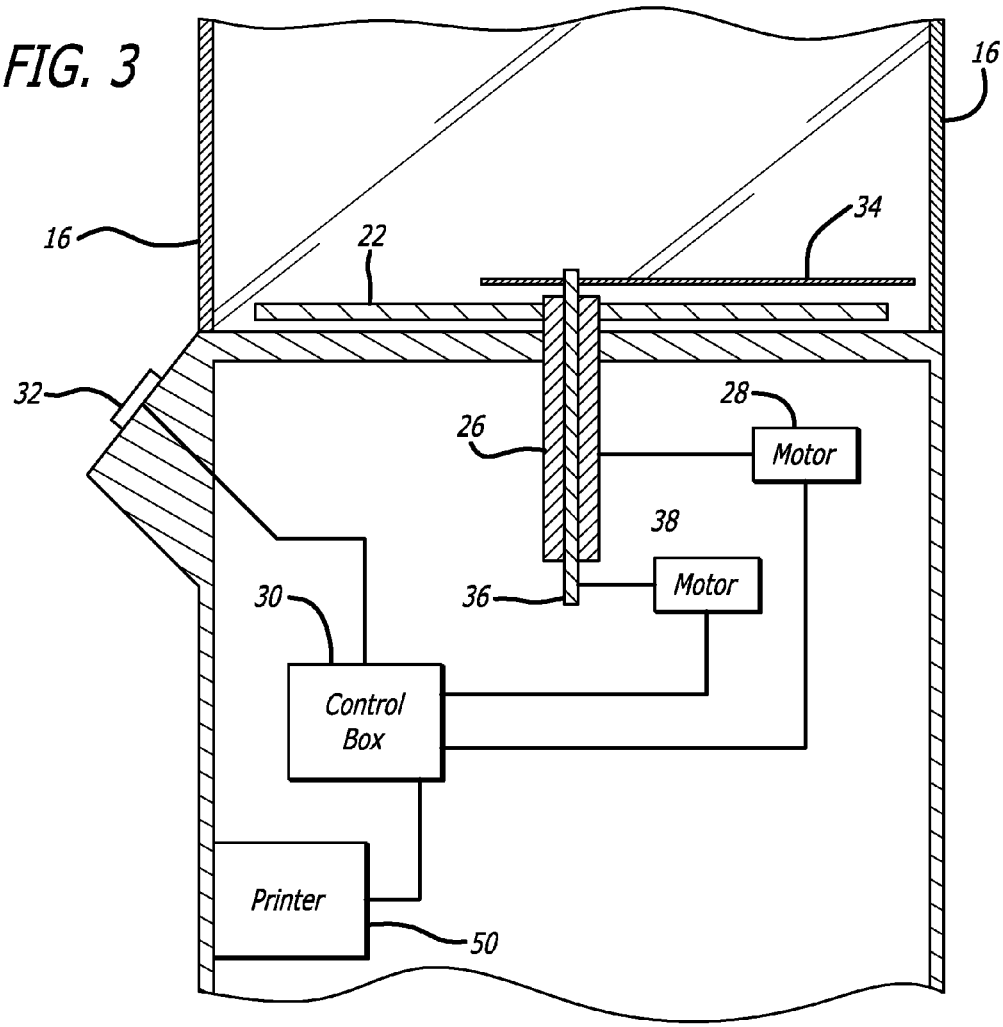
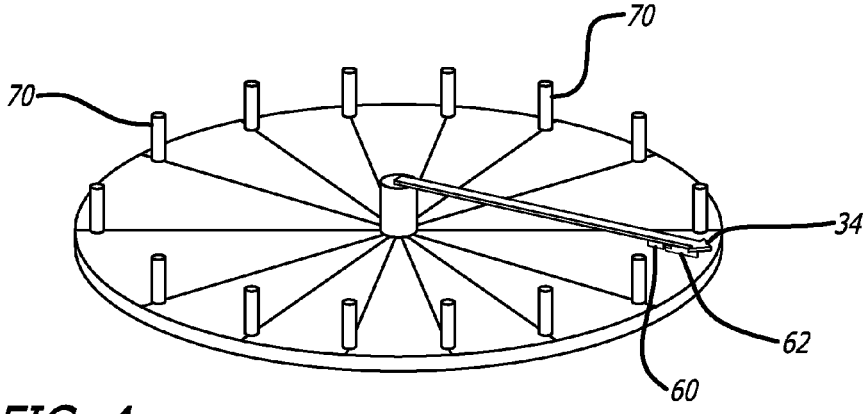
FIG. 4

ARCADE GAME WITH ROTATING AND COUNTER ROTATING POINTER AND TURNTABLE

BACKGROUND

The present invention relates generally to arcade style entertainment apparatus, and more particularly to a coin or token actuated amusement game wherein a player attempts to stop a rotating pointer above a counter-rotating playing field in order to win credits or tickets.

Arcade games that measure a player's skill and luck are well known in the art. The present inventor is the named inventor of many popular games found in today's arcades. For example, U.S. Pat. No. 4,272,082, entitled "Coin Projecting Amusement Device," discloses an amusement wherein coins may be controllably deposited by the player on a playing surface having a multiplicity of surface interruption means thereon. A vertical dam translates over at least a portion of said playing surface and pushes said deposited coins against a random pattern of accumulated coins, causing some of said accumulated coins to fall over an edge into a collecting and counting means. This game is marketed and sold under the trademark "Wedges and Ledges." U.S. Pat. No. 4,303,248, also invented by the present inventor, discloses an amusement game where coins are dropped onto a flat surface over which a vertical dam is horizontally translated. The vertical dam translates over a portion of the flat surface and drops a certain of the accumulated coins over the edge. As the coins drop over the edge, they are collected in a counting chute to be synchronously counted in a memory which is then unloaded to vend out a corresponding number of tokens.

U.S. Pat. No. 4,726,585 also discloses an amusement apparatus in which a player controls a pushing device to push items off of a playing field. A moveable surface is driven in a first pre-determined path and the pusher device is moveable in a linear path traverse to the path travel of the moveable surface. A delivery passage at one end of the path of the pusher device is arranged to deliver any item swept off the surface to a retrieval bin. U.S. Pat. No. 4,822,045 is directed to an amusement device comprised of a pair of spaced apart elongate members defining a track, and a rolling member for rolling along that track under control of an operator. The elongate members are spaced a fixed distance apart at their first ends establishing the normal home position of the rolling member. The opposite, second ends of the elongate members are moveable relative to one another to adjust their spacing and to control the movement of the rolling member along the track. The operator controls the separation of the elongate member so that the rolling member can roll from its home position to the opposite end of the track without falling between the opening separating the elongate members.

U.S. Pat. No. 5,553,865 discloses a rotary arcade game including a turntable having a central aperture. Prizes are positioned on the surface of the turntable and moved by a pivoting arm member operated by the player. The player attempts to manipulate an arm member to push prizes into a collection pocket where they are detected and dispensed to the player. U.S. Pat. No. 5,855,374 is directed to a crane game using a vacuum to selectively pick up prizes within a bin. The prizes are arrayed on a rotating turntable, and the player manipulates a vacuum pick up device linearly along a radial direction of the turntable to pick up prizes below. U.S. Pat. No. 6,139,429 discloses another crane game using a video screen for displaying images. A maneuverable sensor contacts the display screen to select prizes displayed thereon. U.S. Pat. No. 6,095,519 discloses an arcade game including a directing mechanism for aiming a game piece such as a token. U.S. Pat. No. 6,598,881 discloses a crane game with a prize redistribution mechanism for dispersing prizes to a substantially level configuration. Finally, U.S. Pat. No. 6,770,001 discloses a vacuum crane game with targets having beaded portions that vary the difficulty of acquiring said targets.

U.S. Pat. No. 6,991,230 discloses an amusement device in the form of an arcade game that comprises a rotating playing field arrayed with targets at the perimeter. Using a projectile such as a token or coin, the player drops the projectile into a chute in an attempt to knock down the targets on the rotating playing field. If the player knocks over a target with the projectile, the target is recognized by a detector and then returned to its original position for subsequent play.

U.S. Pat. No. 7,168,702 invented by the present inventor discloses an arcade type amusement device wherein a projectile such as a token is aimed at a target via a guidance mechanism such as an elongate chute. A deflector may be used to alter the path of the projectile, where the deflector is intermittently present along the trajectory of the projectile so as to require timing to engage the deflector. Upon a successful strike of the target, a ball is released down a helical track toward a rotating playing field interspersed with holes assigned various values. When a ball reaches the rotating playing field, it will rebound and roll until it falls within one of said holes, whereupon a point value is awarded based on the particular value of the hole. The player may receiver redemption tickets or points based on the point value awarded.

The foregoing illustrate some of the many arcade type games credited to the present inventor. The games are predominantly skill-based with an element of luck woven into the overall operation of the games. The present invention is the inventor's most recent creation in this line of arcade type games.

SUMMARY OF THE INVENTION

The present invention is an arcade type game in which a circular turntable rotates in a first direction and includes a plurality of designations corresponding to pie-shaped areas and point values associated with the areas, and a pointer centered on the turntable that rotates in the opposite direction. The turntable sits in housing that is divided in quadrants, where each quadrant is associated with a multiplier or percentage. When the game is played, the turntable and the pointer rotate in opposite direction, as the pointer passes over the pie shaped areas of the turntable. The player stops the rotations (or causes the rotations to coast to a stop), and the player's result is based on the particular pie-shaped area that the pointer overlays when all the rotations have stopped, multiplied by the value assigned to the quadrant that the pointer is present.

BRIEF DESCRIPTION OF THE DRAWINGS

FIG. 3 is a cross sectional view side of the present invention, showing in schematic form elements of the operational components;

FIG. 4 is an elevated perspective view of the turntable with a position recognizing system.

DETAILED DESCRIPTION OF THE PREFERRED EMBODIMENTS

Figure 1:
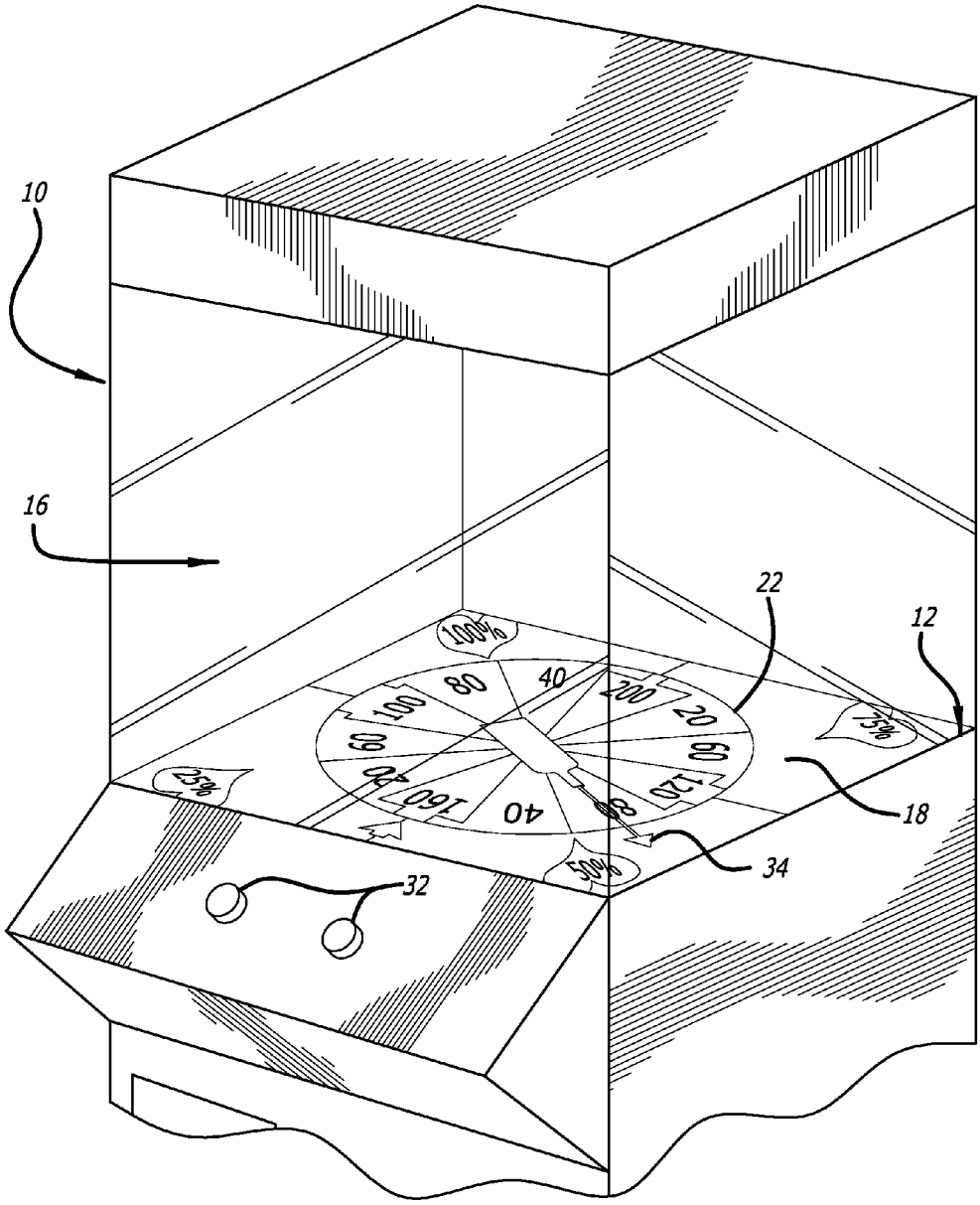
FIG. 1 is an elevated perspective view of a first embodiment of the present invention.

FIG. 1 illustrates a first preferred embodiment of the present invention, comprising an amusement device 10 having a housing 12 that encloses a playing field 14. The portion of the housing 12 that surrounds the playing field 14 is preferably made of a transparent Plexiglas or acrylic window 16 that allows players to look into the housing 12 and see the playing field 14. The playing field 14 includes a generally flat surface 18 that is divided into four quadrants 20, although other configurations and number of subdivisions are also possible. In one preferred embodiment, each quadrant 20 is assigned a multiplier such as 25%, 50%, 75%, and 100%, although again other values increasing or decreasing the total are within the scope of the invention. The values assigned to the quadrant play a role in the outcome of the game, as will be explained below.

Figure 2:
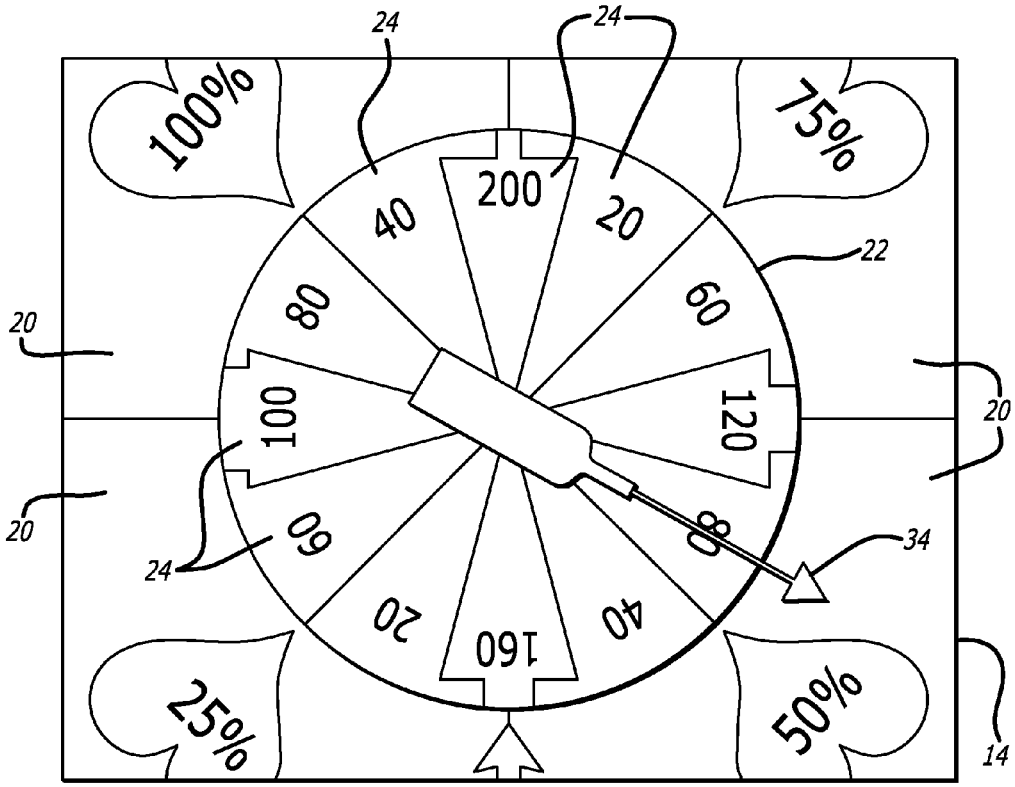
FIG. 2 is a plan view of the playing field, turntable, pointer, and quadrants of the present invention.

Disposed in the middle of the quadrants 20 (see FIG. 2) is a turntable 22 divided into radial sectors 24. The sectors 24 can be uniform size or vary is their angular width, and each sector 24 on the turntable 22 is assigned a point value. The point value can be a credit or monetary value, or can represent prizes, redemption points, or tickets. As shown in FIG. 3, the turntable 22 is coupled an annular spindle 26 that is driven by a motor 28 (or hand spun in an alternate embodiment) in a first direction. The motor 28 is controlled by a control box 30 that receives input from the player controls 32. For example, when the player activates player controls (e.g., presses the button) 32, a signal is sent from the player controls 32 to the control box to start or stop the motor 28, which causes the turntable 22 to stop or coast to a stop. The motor or motors and reversing gears may be controlled by a variable potentiometer to modify the speed of the rotations. This system can be operated by the microprocessor, or controlled by a knob adjusted by the player.

In addition to the turntable 22, the playing field includes an elongate indicator 34 that is connected to a second spindle 36 received inside the first annular spindle 26. The second spindle 36 is coupled to a second motor 38, or a reversing gear (not shown) which causes the spindle 36 and the elongate indicator 34 to rotate above the turntable 22 and in the opposite direction. Control over the second motor 38 or reversing gear is also controlled by the control box 30, which receives a signal from the player controls 32. As with the turntable 22, when the player activates the player controls 32, a signal is sent to the control box 30 to start or stop the motor 38, causing the elongate indicator 34 to stop or coast to a stop.

The game begins when a player inserts a coin, token, game card, magnetic card, or other form of payment. In a preferred embodiment, the insertion of payment by the player starts motors 28 and 38, which in turn rotates spindles 26 and 36, respectively, in opposite directions. Through the window 16, the player can observe the elongate indicator 34 spinning above the turntable 22 in counter-rotating motions. At some instant selected by the player, the player controls 32 are actuated by the player which sends a signal to the control box 30. The control box 30 then sends a signal to the motors 28,38 to stop, whereupon the spindles 26, 36 begin to slow down and eventually stop. When the spindles 26, 36 stop, the elongate indicator 34 will overlay one of the plurality of sectors 24 on the turntable 22. Whatever "value" is assigned to the sector 24 that coincides with the elongate indicator 34 when both the indicator 34 and turntable 22 have stopped rotating is the "award" that is won by the player, adjusted by the multiplier of the particular quadrant 20. For example, if the indicator 34 stops above a sector 24 that corresponds to a value of "200," and the multiplier for the quadrant 20 that the indicator 34 comes to rest in is "50%", then the player is awarded "100" points. Conversely, if the indicator falls on "200" and the multiplier is "2," the award would be 400 points. The award can come in the form of a receipt that is printed by a printer 50, tickets, tokens, magnetic card, or some other prize distribution device, or some other type of reward system.

FIG. 4 illustrates a system for recognizing the position of the indicator 34 over the turntable 22. In one embodiment, each sector 24 is delineated by posts or markers 70 at the periphery of the turntable 22. The indicator 34 includes a sensor 60 with a switch 62 that is triggered every time the actuator 34 passes a marker 70. A signal is sent to the microprocessor within the control box 30 each time a marker 70 is passed, and the microprocessor using logic designed to keep track of the actuator 34 recognizes which sector 24 the actuator 34 overlays. Because the logic also has in its memory the values assigned to each sector, the microprocessor can determine the result of the game when the actuator and turntable come to rest. Similarly, a similar counter can be used to keep track of the quadrants so that the microprocessor knows which multiplier to use on the point value of the sector. The switch 62 can be a mechanical switch, an optical switch, a magnetic switch, or any other type of switch that can detect the passing of each sector 24 using some object that is detected by the switch (magnet, light source, post, etc.).

While particular embodiments have been described above with respect to the present invention, they are not intended to be limiting. Modifications and alterations would be readily apparent to one of ordinary skill in the art, and the present invention is intended to include all such modifications and alterations. Therefore, the scope of the invention should be determined by the words of the appended claims, using their ordinary meanings, with in the context of the foregoing disclosure by without limitation thereby.

I claim:

1. An amusement game comprising:

a housing including an upper portion and a lower portion, the upper portion including a playing area and a transparent wall for viewing the playing area;

a circular, disk-shaped turntable mounted to a first motor for rotation within the playing area in a first direction, the circular, disk-shaped turntable including sector delineations and values assigned to each sector, where said sector delineations coincide with vertical markers extending from an upper surface of the circular disk-shaped turntable at a common radius;

an elongate pointer extending from a spindle passing through a center of the circular, disk-shaped turntable, the spindle mounted to a second motor for rotation within the playing area in an opposite direction, where the turntable and pointer rotate about a common vertical axis of rotation;

a sensor mounted to the elongate pointer and aligned radially with the markers for sensing each marker passed by the pointer, and communicating a signal to a microprocessor for each marker passed;

player controls for generating signals to start and stop the turntable and pointer;

a control box with the housing for receiving signals from the player controls, and actuating the first and second motors based on signals from the player controls; and a microprocessor for determining, after the pointer and turntable has stopped, a sector coinciding with the pointer and a value associated with the sector based on the number of markers passed;

wherein the microprocessor further modifies the value associated with the sector determined to coincide with the pointer based on a quadrant that the pointer is located.

2. The amusement game of claim 1, wherein the sector is determined based on a position of the first and second motors.

3. The amusement game of claim 1, wherein the game includes a redemption ticket dispenser for dispensing redemption tickets based on the modified value.

4. The amusement game of claim 1, wherein the game includes a receipt printer for printing a credit receipt based on the modified value.

5. The amusement game of claim 1, wherein the game includes a prize access bin that may be unlocked based on the modified value.

6. The amusement game of claim 1, wherein the turntable and pointer are rotated and stopped with a single button.

* * * * *